US009464612B2

(12) United States Patent
Okamoto et al.

(10) Patent No.: US 9,464,612 B2
(45) Date of Patent: Oct. 11, 2016

(54) FUEL INJECTION VALVE

(71) Applicant: Hitachi Automotive Systems, Ltd., Hitachinaka-shi, Ibaraki (JP)

(72) Inventors: Yoshio Okamoto, Omitama (JP); Nobuya Sekiyama, Yokohama (JP); Yoshihito Yasukawa, Hitachinaka (JP); Noriyuki Maekawa, Kashiwa (JP); Nobuaki Kobayashi, Maebashi (JP); Takahiro Saito, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 97 days.

(21) Appl. No.: 13/768,718

(22) Filed: Feb. 15, 2013

(65) Prior Publication Data

US 2013/0256428 A1 Oct. 3, 2013

(30) Foreign Application Priority Data

Mar. 30, 2012 (JP) ..... 2012-078785

(51) Int. Cl.

| | |
|---|---|
| ***F02M 61/18*** | (2006.01) |
| ***F02M 61/16*** | (2006.01) |
| ***F02M 51/06*** | (2006.01) |
| ***B05B 1/18*** | (2006.01) |
| ***B05B 1/34*** | (2006.01) |

(52) U.S. Cl.

CPC ..... *F02M 61/162* (2013.01); *B05B 1/185* (2013.01); *B05B 1/341* (2013.01); (Continued)

(58) Field of Classification Search

CPC ..... F02M 61/162; F02M 61/163; F02M 61/1806; F02M 61/1813; F02M 61/182; F02M 61/1846; F02M 61/1853; B05B 1/185; B05B 1/341

USPC ..... 239/533.2, 533.3, 585.1, 533.12, 239/533.14, 463, 483, 494, 569–586

See application file for complete search history.

(56) References Cited

U.S. PATENT DOCUMENTS 6,405,945 B1 * 6/2002 Dobrin ..... F02M 51/061 239/463
6,786,423 B2 * 9/2004 Peterson, Jr. ..... F02M 61/1853 239/5

(Continued)

FOREIGN PATENT DOCUMENTS

JP 3-111660 A 5/1991
JP 7-35001 A 2/1995

(Continued)

OTHER PUBLICATIONS

Japanese Office Action dated May 12, 2015, with English translation (Six (6) pages).

*Primary Examiner* — Arthur O Hall
*Assistant Examiner* — Christopher R Dandridge
(74) *Attorney, Agent, or Firm* — Crowell & Moring LLP

(57) ABSTRACT

An object of the present invention is to provide a fuel injection valve that is made superior in atomization performance by preventing an influence of minute deformation occurring when an orifice plate is assembled to a nozzle body, thereby reducing fuel leakage from a swirling passage to increase the strength of a swirl flow. The valve includes a valve body openable and closable to jet fuel; a nozzle body having a valve seat surface capable of coming into contact with the valve body to block the jet of fuel; and an orifice plate disposed downstream of the valve seat surface and having a plurality of fuel injection holes adapted to jet swirl fuel. The nozzle body has an end face portion with a downwardly convex inclined surface.

12 Claims, 8 Drawing Sheets

(52) U.S. Cl.
CPC ..... *F02M 51/0664* (2013.01); *F02M 61/163* (2013.01); *F02M 61/182* (2013.01); *F02M 61/1806* (2013.01); *F02M 61/1813* (2013.01); *F02M 61/1846* (2013.01); *F02M 61/1853* (2013.01)

(56) References Cited

U.S. PATENT DOCUMENTS 6,854,670 B2 * 2/2005 Sumisha ..... F02M 51/0678 239/468
7,841,544 B2 * 11/2010 Haddock et al. ..... 239/74
8,225,602 B2 * 7/2012 Cavanagh et al. ..... 60/295
2003/0141385 A1 7/2003 Xu
2004/0011895 A1 * 1/2004 Dantes ..... F02M 51/0671 239/585.1

FOREIGN PATENT DOCUMENTS

JP 10-18943 A 1/1998
JP 2003-336562 A 11/2003
JP 2004-278464 A 10/2004
JP 2006-105003 A 4/2006

* cited by examiner

FUEL INJECTION VALVE

BACKGROUND OF THE INVENTION

1. Field of the Invention

The present invention relates to a fuel injection valve used for an internal combustion engine and in particular to a fuel injection valve that has a plurality of fuel injection holes and can improve atomizing performance by jetting swirl fuel from the fuel injection holes.

2. Description of the Related Art

The fuel injection valve disclosed in JP-2004-278464-A is known as a conventional technology for promoting the atomization of fuel jetted from the fuel injection holes by the use of swirl flow.

The fuel injection valve includes a valve seat member having a valve seat which cooperates with a valve body and has an opening at its downstream end toward the front end face of the valve seat member, and includes an injector plate joined to the front end face of the valve seat member. There are provided lateral-directional passages communicating with the downstream end of the valve seat and swirl chambers each formed by tangentially opening the corresponding downstream ends of the lateral-directional passages, between the valve seat member and the injector plate. The injector plate is bored with fuel injection holes each adapted to jet the fuel subjected to swirl in the swirl chamber. The curvature radius of the inner circumferential surface of the swirl chamber is gradually reduced from the upstream side toward the downstream side in the direction along the inner circumferential surface of the swirl chamber. In other words, the curvature is gradually increased from the upstream side toward the downstream side in the direction along the inner circumferential surface of the swirl chamber. In addition, the inner circumferential surface of the swirl chamber is formed along an involute curve having a base circle in the swirl chamber.

In this fuel injection valve, an overlapping surface between the thick-walled portion of a passage plate and the injector plate is formed to have two slope faces inclined in a V-shape with respect to the axis of the valve seat. In addition, the fuel injection holes are divided into two sets each arranged at a slant in directions opposite to the other.

With the configuration described above, the atomization of fuel from each of the fuel injection holes can effectively be promoted. In addition, the injecting direction of fuel can be varied.

The fuel injection valve described in JP-7-35001-A is known as a conventional technology for promoting the atomization of fuel by the use of swirl force and for distributing fuel into a plurality of holes to make mixing with air satisfactory.

SUMMARY OF THE INVENTION

It is known that when fuel subjected to swirl force is jetted, fuel spray is formed in a hollow conical shape. Such a fuel spray is changed into liquid droplets from a liquid membrane state via liquid ligament break-up and becomes an atomized fuel spray.

If mounting on an engine, a fuel injection valve is required to be slim in view of mounting performance. Accordingly, since the injection portion is configured as a nozzle portion with small dimensions, various devices are needed to extract injection performance in consideration of a performance aspect, manufacturing and assembly and so on.

In the conventional technology described in JP-2004-278464-A, the passage plate is configured such that a portion having the lateral-directional passage and the swirl chamber communicating therewith is formed as the thick-walled portion. In addition, the outer circumferential portion of the thick-walled portion is formed as a thin-walled portion. A thin plate-like injector plate having fuel injection holes is put on and circumferentially fixed to the thin-walled portion. For fixation, the energy applied to the outer circumferential portion is efficiently used during welding (laser welding is known). In addition, a method of increasing the degree of freedom of injection characteristics involves forming the overlapping surface between the thick-walled portion and the injection plate into the V-shape, thereby making it possible to change an injection direction.

According to the configuration described above, although the outer circumferential portion can be fixedly secured as designed, it is difficult to prevent the deformation (curving) of the thinned injector plate.

As a result, a minute clearance will occur above the lateral-directional passages and the swirl chambers.

In particular, the lateral-directional passage is an important region to produce swirl fuel. Because of the occurrence of the clearance, fuel leakage occurs, which reduces the swirl force. Because of variations in clearances, variations in the swirling strength of the fuel supplied to the fuel injection holes occur. Further, there is concern that the symmetry of a swirl flow at the outlet of the injection hole may be impaired.

As a result, atomization performance is impaired or the shape of fuel spray is varied. Further, robustness is impaired in terms of injecting-direction control.

The conventional technology described in JP-7-35001 includes the configuration for distributing atomized fuel; however, it does not disclose methods for processing and assembling a swirling passage and a swirl chamber, which require high-accurate processing.

The present invention has been made in view of such situations and aims to provide a fuel injection valve that is superior in atomization performance and in shape controllability by solving a problem about minute deformation occurring when a plate-like member having fuel injection holes adapted to jet swirl fuel is assemble to a nozzle body, and by eliminating the interference of fuel sprays, which poses a problem when fuel injection holes are arranged close to each other.

According to an aspect of the present invention, there is provided a fuel injection valve including a valve body openable and closable to jet fuel and block the jet of fuel; a nozzle body having a valve seat surface capable of coming into close contact with the valve body to block the jet of fuel; and an orifice plate disposed downstream of the valve seat surface and has a plurality of fuel injection holes adapted to jet swirl fuel; wherein the nozzle body has an end face portion with a downwardly convex inclined surface, the inclined surface is formed stepwise such that a plane corresponding to a swirling passage is located slightly lower than a plane corresponding to a swirl chamber, and the orifice plate having the swirling passage and the swirl chamber is fixedly inserted into the nozzle body by being guided by a concave groove-outer circumferential wall portion provided in an outer circumferential portion of the nozzle body.

In this case, the convex lower inclined surface formed on the nozzle body may have a first inclined surface portion corresponding to the swirling passage of the orifice plate and a second inclined surface portion corresponding to the swirl chamber of the orifice plate, the first inclined surface being located upper portion than the second inclined surface portion.

The convex upper inclined surface formed on the orifice plate may have a first inclined surface portion corresponding to the swirling passage of the nozzle body and a second inclined surface corresponding to the swirling chamber of the nozzle body, the first inclined surface being located lower portion than the second inclined surface.

Further, the swirl chamber has a cross-section formed with an involute curve or a helical curve.

According to the aspect of the present invention, the inclined surface of the orifice plate, which corresponds to the swirling passage, is secured to the corresponding inclined surface of the nozzle body in a close contact manner. Therefore, the fuel flowing in the swirling passage can be prevented from leaking. Thus, the fuel can effectively be supplied to the swirl chamber, thereby applying sufficiently swirl force to each of the fuel injection holes.

The nozzle body and the orifice body covering the nozzle body are formed convexly; therefore, the fuel sprays jetted from the fuel injection holes machined perpendicularly to the inclined surface of the orifice plate can effectively be atomized without mutual interference (interference in a liquid-film state) and jetted in predetermined directions.

DESCRIPTION OF THE PREFERRED EMBODIMENTS

Preferred embodiments of the present invention will be described with reference to FIGS. 1 to 8.

A first embodiment of the present invention is described with reference to FIGS. 1 to 7.

First Embodiment

Figure 1:
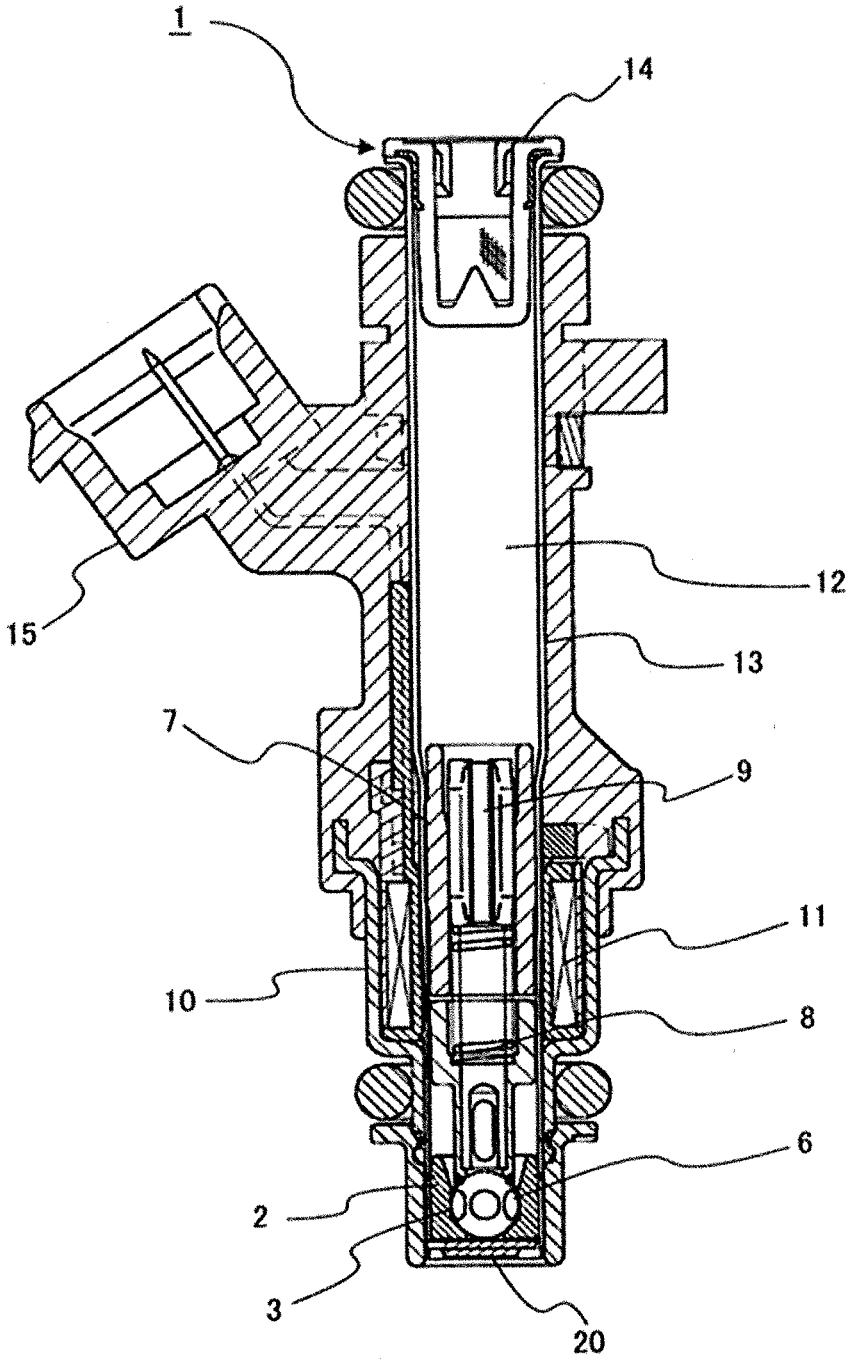
FIG. 1 is a longitudinal cross-sectional view illustrating an overall configuration of a fuel injection valve according to an embodiment of the present invention.

FIG. 1 is a longitudinal cross-sectional view illustrating an overall configuration of a fuel injection valve according to the embodiment of the present invention.

Referring to FIG. 1, the fuel injection valve 1 is configured such that a nozzle body 2 and a valve body 6 are accommodated in a thin-walled pipe 13 made of stainless steel. In addition, the valve body 6 is reciprocated (opening-closing operation) by an electromagnetic coil 11 disposed on the outside the thin-walled pipe 13. The configuration is hereinafter described in detail.

The fuel injection valve 1 includes a yoke 10 composed of a magnetic body surrounding the electromagnetic coil 11; a core 7 located at the center of the electromagnetic coil 11 and having one end in magnetic contact with the yoke 10; the valve body 6 to be lifted at a predetermined amount; a valve seat surface 3 in contact with the valve body 6; a fuel injection chamber 4 adapted to admit the passage of fuel flowing through the gap between the valve body 6 and the valve seat surface 3; and an orifice plate 20 having a plurality of fuel injection holes 23*a*, 23*b*, 23*c* (see FIGS. 2, 4 and 5) and located downstream of the fuel injection chamber 4.

The core 7 has a spring 8 as an elastic member at its central portion. The spring 8 is adapted to press the valve body 6 toward the valve seat surface 3. The elastic force of the spring 8 is adjusted by the pressing amount of a spring adjuster 9 toward the valve seat surface 3.

In the state of the non-energization of the coil 11, the valve body 6 and the valve seat surface 3 are in close contact with each other. In this state, since a fuel passage is closed, fuel stays inside the fuel injection valve 1. That is, fuel is not jetted from each of the plurality of fuel injection holes 23*a*, 23*b*, 23*c* provided on the orifice plate.

On the other hand, if the coil 11 is energized, the valve body 6 is shifted by the electromagnetic force until it comes into contact with the lower end face of the core 7, to which the valve body 6 faces.

In the opened state, a clearance is produced between the valve body 6 and the valve seat surface 3; therefore, the fuel passage is opened so that fuel is jetted from the plurality of fuel injection holes 23*a*, 23*b*, 23*c*.

Incidentally, the fuel injection valve 1 is provided with a fuel passage 12 having a filter 14 disposed at its inlet portion. The fuel passage 12 includes a through-hole portion penetrating the central portion of the core 7 and is a passage adapted to lead the fuel pressurized by a fuel pump not shown to the fuel injection holes 23*a*, 23*b*, 23*c* through the inside of the fuel injection valve 1. The fuel injection valve 1 is coated on its outside portion with a resin mold 15 for electrical insulation.

The fuel injection valve 1 is operated by the energization (injection pulses) of the coil 11 as described above to switch the position of the valve body 6 between the opened state and the closed state, thereby controlling the supply quantity of fuel.

To control the supply quantity of fuel, the valve body is designed to prevent the leakage of fuel particularly in the closed state.

The fuel injection valve of this type uses a ball (a steel ball for a ball bearing as a JIS standard product) that has high circularity and is subjected to mirror finish. This ball is useful for improving seat performance.

On the other hand, the valve seat surface 3 in close contact with the ball is set at an optimum valve seat angle of 80° to 100° so as to have satisfactory abradability and circularity with a high degree of accuracy. Dimensional conditions that can maintain extremely high seat performance with the above-mentioned ball are selected for the valve seat surface 3.

Incidentally, the nozzle body 2 having the valve seat surface 3 is increased in hardness by quenching. Further, unnecessary magnetism is removed from the nozzle body 2 by demagnetization.

The configuration of the valve body 6 enables injection amount control without the leakage of fuel.

Figure 2:
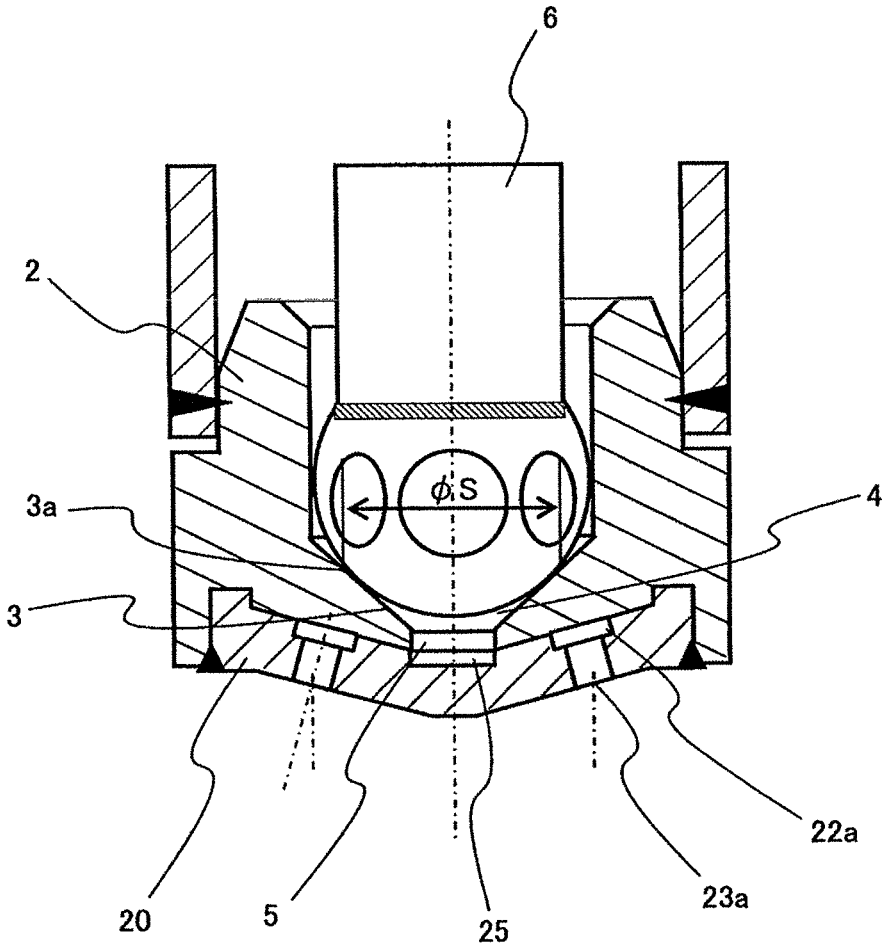
FIG. 2 is a longitudinal cross-sectional view illustrating the vicinity of a nozzle body of the fuel injection valve according to the embodiment of the present invention.

FIG. 2 is a longitudinal cross-sectional view illustrating the vicinity of the nozzle body 2 of the fuel injection valve 1 according to the embodiment of the present invention. As illustrated in FIG. 2, the orifice plate 20 has an upper surface in close contact with the lower surface of the nozzle body 2. The orifice plate 20 is secured to the nozzle body 2 by laser-welding the outer circumference of such a contact portion.

Incidentally, the vertical direction in the present specification and claims is based on FIG. 1. In the axial direction of the fuel injection valve 1, the fuel passage 12 side is defined as the upper side and the fuel injection hole 23*a*, 23*b*, 23*c* side is defined as the lower side.

The nozzle body 2 is provided at its lower end portion with a fuel introduction hole 5 having a diameter smaller than an diameter ϕS of a seat portion 3*a* of the valve seat surface 3. The valve seat surface 3 is formed into a conical shape and has the fuel introduction hole 5 at the central portion of the downstream end thereof. The valve seat surface 3 and the fuel introduction hole 5 are formed so that the centerline of the valve seat surface 3 and the centerline of the fuel introduction hole 5 may coincide with the axis of the fuel injection valve. The fuel introduction hole 5 is formed at the lower end face of the nozzle body 2 as an opening communicating with a central hole (a central bore) 25 of the orifice plate 20.

The configuration of a plurality of fuel passages formed in the orifice plate 20 is previously described with reference to FIG. 5.

The central hole 25 is a concavely shaped groove portion provided at the central portion of the orifice plate 20. Swirling passages 21*a*, 21*b*, 21*c* radially extend from the central hole 25. The swirling passages 21*a*, 21*b*, 21*c* have respective upstream ends communicating with the inner circumferential surface of the central hole 25.

The swirling passages 21*a*, 21*b* and 21*c* are connected at respective downstream ends to swirl chambers 22*a*, 22*b* and 22*c*, respectively, for communication with each other. The swirling passages 21*a*, 21*b* and 21*c* are respective fuel passages adapted to supply fuel to the swirl chambers 22*a*, 22*b* and 22*c*, respectively. In this sense, the swirling passages 21*a*, 21*b*, 21*c* may be called swirl fuel supply passages 21*a*, 21*b*, 21*c*.

The wall surfaces of the swirl chambers 22*a*, 22*b*, 22*c* are each formed such that its curvature is gradually increased (its curvature radius is gradually reduced) from the upstream side toward the downstream side. In this case, the curvature may continuously be increased. Alternatively, the curvature may gradually be increased stepwise from the upstream side toward the downstream side while it is made constant in a predetermined range. Representative examples of a curve line whose curvature is continuously increased from the upstream side toward the downstream side include an involute curve (shape) and a helical curve (shape). In the present embodiment, the swirl chambers 22*a*, 22*b*, 22*c* are formed based on the helical curve; however, the fuel injection holes 23*a*, 23*b*, 23*c* are each opened at the center of the helix (the center of a swirl).

Incidentally, if the involute curve line is used for each of the swirl chambers 22*a*, 22*b*, 22*c*, it is preferable that the center of a basic circle of the involute curve line be coincident with the center of the fuel injection hole 23*a*.

The downstream end of the sidewall of each of the swirling passages 21*a*, 21*b*, 21*c* and the terminal end of the inner circumferential wall of a corresponding one of the swirl chambers 22*a*, 22*b*, 22*c* are formed to have a connection surface (an R-portion) with a predetermined thickness. This thick portion is permitted to have a size in a range from approximately 0.01 mm to 0.1 mm. Preferably, a range from approximately 0.02 mm to 0.06 mm may preferentially be adopted.

Because of forming the thick portion as mentioned above, collision is alleviated between the fuel turning around each of the swirl chambers 22*a*, 22*b*, 22*c* and the fuel flowing into a corresponding one of the swirling passages 21*a*, 21*b*, 21*c*. Thus, the smooth flow of fuel along the helical wall surface of each of the swirl chambers 22*a*, 22*b*, 22*c* is formed.

The cross-sectional shape, vertical to the flow direction, of each of the swirling passages 21*a*, 21*b*, 21*c* is oblong (rectangular). The swirling passages 21*a*, 21*b*, 21*c* are each made to have height smaller than each width thereof, whereby they are designed to have dimensions advantageous to press forming.

Since the oblong portion is restricted in size (the minimum cross-sectional area), the fuel flowing into the swirling passages 21*a*, 21*b*, 21*c* can ignore a pressure loss from the seat portion 3*a* of the valve seat surface 3 via the fuel injection chamber 4, the fuel introduction hole 5, the central hole 25 of the orifice plate 20 to a corresponding one of the swirling passages 21*a*, 21*b*, 21*c*.

In particular, the fuel introduction hole 5 and the central hole 25 of the orifice plate 20 are each designed to provide the fuel passage with a desired size so as to prevent the occurrence of a pressure loss caused by sharp curve.

Accordingly, the pressure energy of fuel is efficiently converted into swirl velocity energy at a portion corresponding to each of the swirling passages 21*a*, 21*b*, 21*c*.

Additionally, the fuel flow accelerated by the oblong portion is led to each of the fuel injection holes 23*a*, 23*b*, 23*c* downstream of the corresponding swirling passages 21*a*, 21*b*, 21*c* while maintaining sufficient swirl strength, i.e., sufficient swirl velocity energy.

Incidentally, the swirl chambers 22*a*, 22*b*, 22*c* are each sized to have such a diameter as to reduce an influence of a friction loss resulting from a fuel flow and of a friction loss on the inside wall thereof as much as possible. The size of the diameter is such that about four to six times of the hydraulic diameter will be an optimum value. Also the present embodiment adopts this method.

In the present embodiment, the fuel passages each combined of the swirling passage 21, the swirl chamber 22 and the fuel injection hole 23 are installed so as to be divided equally among three. However, the fuel passages may be installed so as to be divided equally among the further increased number, thereby increasing the degree of freedom of variation in the shape of fuel spray and in injection quantity.

A method of processing the swirling passages 21*a*, 21*b*, 21*c* and the swirl chambers 22*a*, 22*b*, 22*c* and a method of assembling them are next described with reference to FIGS. 3 and 4.

Figure 3:
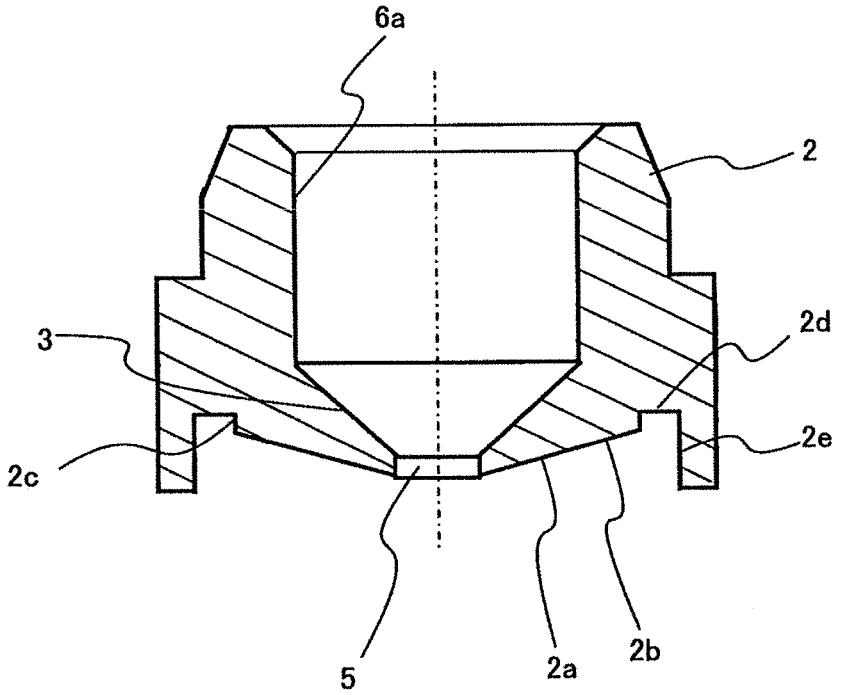
FIG. 3 is a cross-sectional view for assistance in explaining the shape of only the nozzle body of the fuel injection valve according to the embodiment of the present invention.

FIG. 3 is a cross-sectional view illustrating the shape of the nozzle body 2. FIG. 4 is a cross-sectional view of the orifice plate 20.

The nozzle body 2 is formed with: the fuel introduction hole 5 located at its central portion; a mating surface 2*a* for the swirling passages and a mating surface 2*b* for the swirl chambers, the mating surface 2*a* and the mating surface 2*b* being inclined toward the upstream side from the fuel introduction hole 5; and a concave inside wall surface 2*c*, a bottom wall surface 2*d* and an outside wall surface 2*e*, which are continuous with the mating surface 2*b* for the swirl chambers.

The mating surface 2*a* for the swirling passages is a plane corresponding to the swirling passages 21*a*, 21*b*, 21*c* which are formed when the orifice plate 20 is fixedly inserted into the nozzle body 2.

The mating surface 2*a* for the swirling passages is not formed flush with the mating surface 2*b* for the swirl chambers. Specifically, the mating surface 2*b* side for the swirl chambers is located slightly higher than the mating surface 2*a* for the swirling passages. Thus, a slight step (about several ten microns) is formed between the mating surface 2*a* and the mating surface 2*b*.

Figure 4:
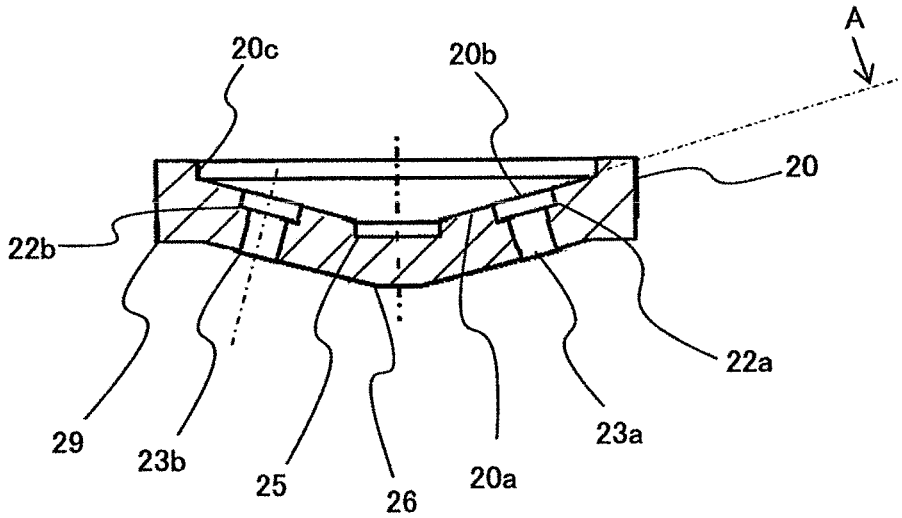
FIG. 4 is a cross-sectional view illustrating an orifice plate of the fuel injection valve according to the embodiment of the present invention.
Figure 5:
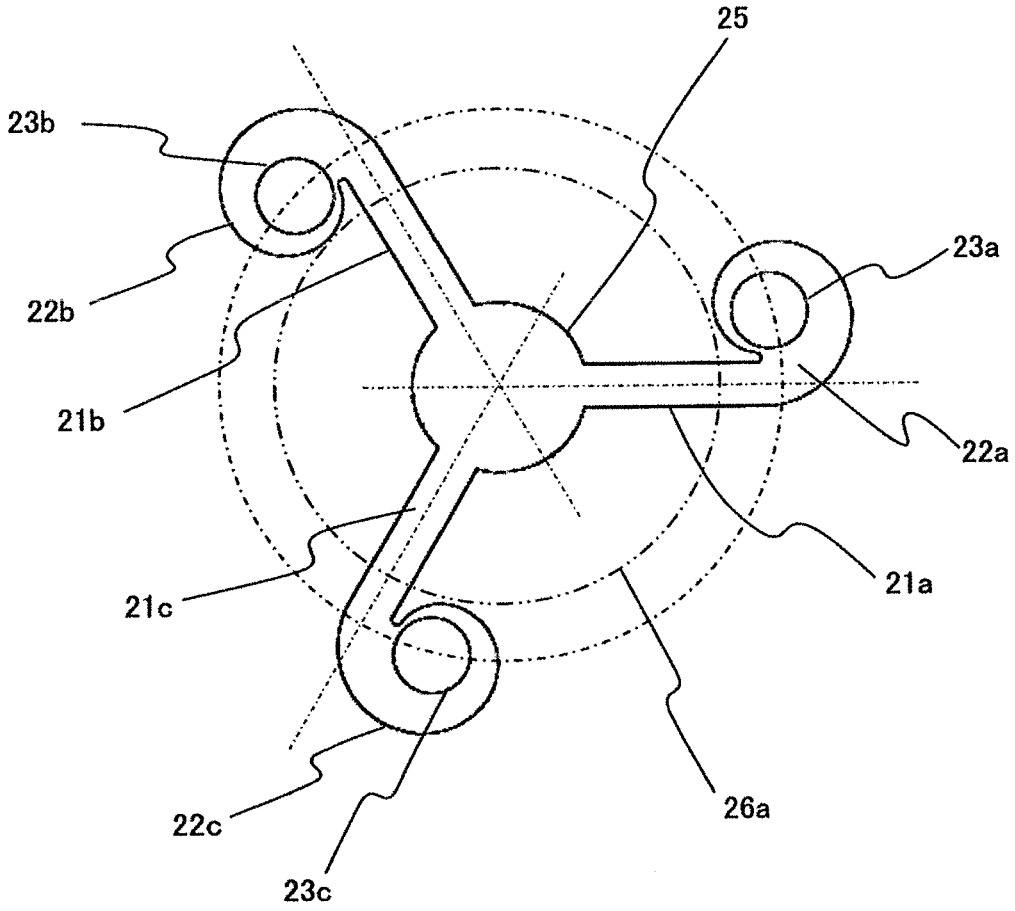
FIG. 5 is a top plan view for assistance in explaining the relationship among swirl chambers, swirling passages and fuel injection holes in the fuel injection valve according to the embodiment of the present invention (viewed in a direction of arrow "A" in FIG. 4).

The position of the step is indicated by an imaginary circle 26*a* illustrated in FIG. 5, which is projected from the direction of arrow A in FIG. 4 and used for the explanation of the fuel passage. The imaginary circle 26*a* is positioned slightly inward (on the axial side) of the axial-side wall surfaces of the swirl chambers 22*a*, 22*b*, 22*c*.

In this way, the swirling passages 21*a*, 21*b*, 21*c* can be covered up to the terminal ends thereof by the mating surface 2*a* for the swirling passages. Thus, fuel leakage from the swirling passages 21*a*, 21*b*, 21*c* can be reduced.

The orifice plate 20 is formed in a convex shape toward the downside so as to have a lowest external surface at its central portion. In addition, the orifice plate 20 has a pressing surface 26 formed at the central portion on a lowest external surface thereof. The pressing surface 26 has a diameter smaller than that of the central hole 25 located at the central portion.

The pressing surface 26 is a pressing portion which is used during the stroke adjustment with the valve body 6 after the orifice plate 20 has been assembled to the nozzle body 2.

A pressing surface 29 is formed at the outer circumferential portion of an inclined surface.

The pressing surface 29 is a pressing portion which is used when the orifice plate 20 is assembled to the nozzle body 2.

On the other hand, the orifice plate 20 is formed, on an upper inside thereof, with the radially extending swirling passages 21*a*, 21*b*, 21*c* communicating with the central hole 25 and with the corresponding swirl chambers 22*a*, 22*b*, 22*c*.

A mating surface 20*a* for the swirling passages may be flush with a mating surface 20*b* for the swirl chambers. However, it is preferred that a slight step be formed between the mating surface 20*a* for the swirling passages and the mating surface 20*b* for the swirl chambers. In this case, it is preferred that the mating surface 20*b* for the swirl chambers be designed to be slightly offset toward the downside direction of the mating surface 2*a* for the swirling passages.

In this way, the mating surface 20*a* for the swirling passages and the mating surface 2*a* for the swirling passages come into contact with each other, which can reduce fuel leakage from the swirling passages 21*a*, 21*b*, 21*c*.

The orifice plate 20 has an outer shape portion formed to have a size in which the orifice plate fits to an outside wall surface 2*e* of the concave portion formed on the nozzle body 2. The orifice plate 20 is fixedly inserted into the nozzle body 2 by its outer shape portion being guided by the outside wall surface 2*e*. When the orifice plate 20 is fixedly press-fitted to the nozzle body 2, a flat surface portion on the outer circumferential side thereof is used as a pressing surface.

If the orifice plate 20 is fixedly press-fitted to the nozzle body 2, the mating surface 20*a* for the swirling passages of the orifice plate 20 comes into close contact with the mating surface 2*a* for the swirling passages of the nozzle body 2. The mating surfaces are formed to increase the degree of adhesion so as to have practically no gap therebetween.

On the other hand, the mating surface 20*b* for the swirl chambers of the orifice plate 20 and the mating surface 2*b* for the swirl chambers of the nozzle body 2 are formed to have a slight gap therebetween.

With the configuration described above, all the fuel flowing through the swirling passages 21*a*, 21*b*, 21*c* are supplied toward the corresponding swirl chambers 22*a*, 22*b*, 22*c* without leakage at least from the swirling passages 21*a*, 21*b*, 21*c*. Thus, the fuel flows into each of the swirl chambers 22*a*, 22*b*, 22*c* while keeping its pressure, thereby increasing swirl force.

A slight clearance δ3 (see FIG. 6) is defined below the mating surface 2*b* for the swirl chambers 22*a*, 22*b*, 22*c*. However, fuel does not swirly flow at this portion but remains staying in the upper clearance. Thus, the flow of the fuel in the swirl chambers 22*a*, 22*b*, 22*c* will not be obstructed.

Figure 6:
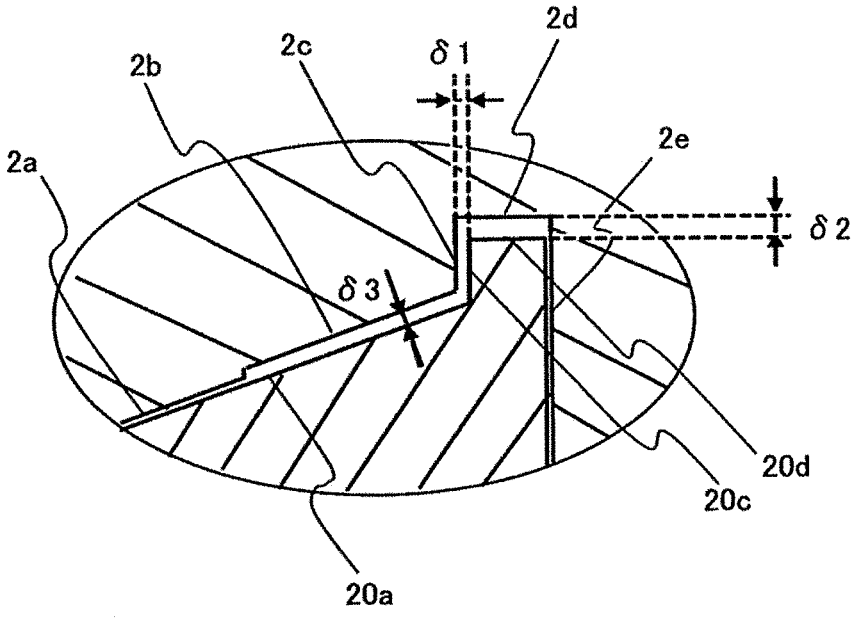
FIG. 6 is an enlarged cross-sectional view illustrating a fitted portion between the nozzle body and the orifice plate according to the embodiment of the present invention.

FIG. 6 is a partially enlarged cross-sectional view illustrating a fitted state between the nozzle body 2 and the orifice plate 20.

An inner circumferential-side wall surface 20*c* of the orifice plate 20 is formed to have a diameter greater than that of a concave inside wall surface 2*c* of the nozzle body 2. Because of this, a clearance δ1 is defined between the wall surface 20*c* and the inside wall surface 2*c* when the orifice plate 20 is fixedly inserted into the nozzle body 2.

A slight clearance δ2 is defined also between an outer circumferential end face 20*d* on an upper portion of the orifice plate 20 and a concave bottom face 2*d* of the nozzle body 2.

These clearances δ1, δ2 have the relationship of δ2>δ1. That is to say, the clearances are design to accommodate unnecessary deformation occurring when the orifice plate 20 is fixedly press-fitted to the nozzle body 2.

Figure 7:
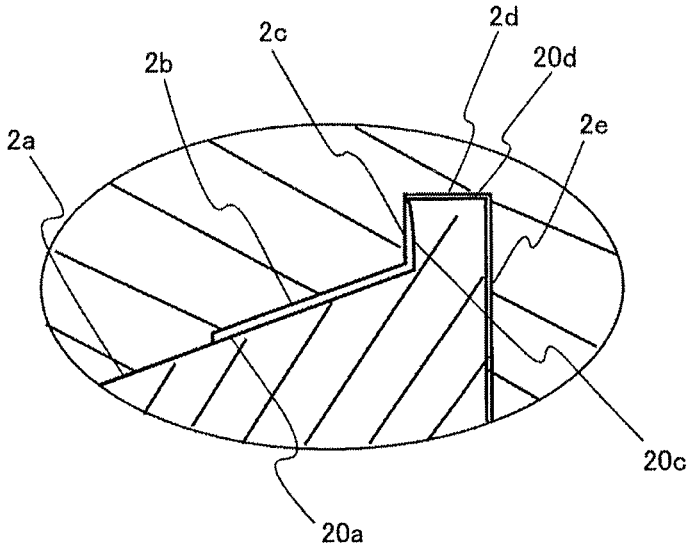
FIG. 7 is an enlarged cross-sectional view illustrating a press-fit state of the nozzle body and the orifice plate according to the embodiment of the present invention.

A description is given with reference to FIG. 7. When the orifice plate 20 is press fitted to the nozzle body 2, the mating surface 20*a* for the swirling passages first comes into contact with the mating surface 2*a* for the swirling passages. When the orifice plate 20 is further pressed, since the clearance δ2 is greater than the clearance δ1, the pressing surface 29 can be pressed against the nozzle body 2 while increasing the adhesion between the mating surface 20*a* for the swirling passages and the mating surface 2*a* for the swirling passages without the contact of the convex surface 20*d* with the bottom wall surface 2*d*.

In this case, although the wall surface 20*c* is slightly deformed, the clearance δ1 can accommodate the amount of the deformation.

Incidentally, the step is formed between the mating surface 2*a* for the swirling passages of the nozzle body 2 and the mating surface 2*b* for the swirl chambers. However, it is no problem that the mating surface 2*a* for the swirling passages of the nozzle body 2 and the mating surface 2*b* for the swirl chambers may continuously be connected to each other via a minute corner R or the like.

Second Embodiment

Figure 8:
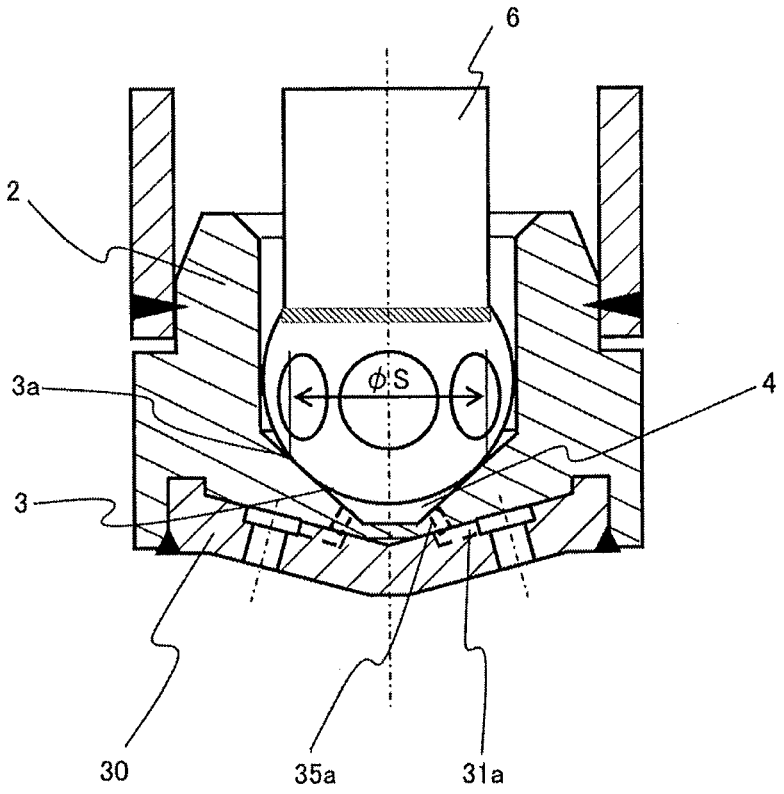
FIG. 8 is a longitudinal cross-sectional view for assistance in explaining a nozzle body of a fuel injection valve according to another embodiment of the present invention.

A fuel injection valve according to a second embodiment of the present invention is hereinafter described with reference to FIG. 8. FIG. 8 is a longitudinal cross-sectional view illustrating the vicinity of a nozzle body.

The fuel injection valve of the second embodiment is different from that of the first embodiment in that a plurality of fuel introduction holes are provided at a lower end portion of the fuel injection valve. Thus, a fuel flow path from a fuel injection chamber is provided at a plurality of locations.

As shown in FIG. 8, fuel introduction holes 35*a* communicate with a fuel injection chamber 4 on their upstream ends. In addition, the fuel introduction holes 35*a* communicate respective swirling passages 31*a* formed in an orifice plate 30.

The configuration described above can prevent the sharp curve of the fuel passage; therefore, a flow loss is extremely small and fuel flows from the fuel introduction holes 35*a* via the swirling passages 31*a* and reaches corresponding swirl chambers provided on the downstream thereof. Therefore, since swirling force is effectively applied to the fuel, a uniform fuel thin-film is jetted at the outlet of the fuel injection hole. As a result, the atomization characteristics of fuel are extremely superior and the same functions and effects as those of the first embodiment can be produced.

The embodiment described above concurrently has also the following functions and effects.

The volume of the fuel passage determined by the fuel injection chamber 4 and the fuel introduction holes 35*a* can sufficiently be reduced. Therefore, an extra route for flow from the fuel injection chamber 4 and the fuel introduction holes 35*a* to swirl chambers is eliminated. Thus, turbulence such as swirls or the like does not occur, thereby remarkably improving the robustness of an injection quantity and the shape control of fuel spray.

As described above, the fuel injection valve according to the embodiment of the present invention is such that the inclined surface for the swirling passages adapted to form swirl fuel in the orifice plate and the inclined surface of the nozzle body corresponding to the former inclined surface are brought into close contact with each other for fixation. This prevents the fuel passing through the swirl passages from leaking outwardly therefrom. Fuel is effectively supplied to the swirl chambers. Thus, the uniform and sufficient swirl force can be applied to the fuel for each of the fuel injection holes.

The nozzle body and the orifice plate covering the nozzle body are formed convexly. Accordingly, fuel sprays jetted from the fuel injection holes machined perpendicularly to the corresponding inclined surfaces do not interfere with each other. The interference in a liquid membrane state, which poses a problem when the fuel injection holes are arranged close to each other, can be avoided. Thus, the fuel injection valve can be provided that is superior in atomization performance and in shape controllability.

What is claimed is:

1. A fuel injection valve comprising:

a valve body openable and closable to a jet fuel and block the jet of fuel;

a nozzle body having a valve seat surface capable of coming into contact with the valve body to block the jet of fuel the nozzle body having a recess defining a convex end portion; and an orifice plate disposed downstream of the valve seat surface with respect to a flow of fuel and having a swirling passage adapted to allow fuel to pass therethrough, a swirl chamber disposed downstream of the swirling passage, and a plurality of fuel injection holes adapted to jet swirl fuel, wherein the nozzle body has an end face portion, which is immediately adjacent to, and in direct contact with, the orifice plate, that defines a downwardly convex inclined surface, the orifice plate having the swirling passage and the swirl chamber is fixedly inserted into the nozzle body by being guided by a concave groove-outer circumferential wall portion provided in an outer circumferential portion of the nozzle body, the end face portion defines a stepped portion, the orifice plate has a complimentary concave end face to be received in the recessed forming the convex end portion of the nozzle body wherein the convex inclined surface formed on the nozzle body so as to face the orifice plate has a first inclined surface portion facing the swirling passage of the orifice plate and a second inclined surface portion facing the swirl chamber of the orifice plate and wherein a convex inclined surface formed on the orifice plate so as to face the nozzle body has a first inclined surface portion facing the swirling passage and a second inclined surface portion facing the swirl chamber.

2. The fuel injection valve according to claim 1, wherein the first inclined surface portion formed on the nozzle body is located closer to the orifice plate than the second inclined surface portion formed on the nozzle body.

3. The fuel injection valve according to claim 1, wherein the first inclined surface portion formed on the orifice plate is located closer to the nozzle body than the second inclined surface portion formed on the orifice plate.

4. The fuel injection valve according to claim 1, wherein the swirl chamber has a cross-section formed by an involute curve or a helical curve.

5. The fuel injection valve according to claim 2, wherein the swirl chamber has a cross-section formed by an involute curve or a helical curve.

6. The fuel injection valve according to claim 3, wherein the swirl chamber has a cross-section formed by an involute curve or a helical curve.

7. A fuel injection valve comprising:

a valve body openable and closable to a jet fuel and block the jet of fuel;

a nozzle body having a valve seat surface that contacts the valve body to block the jet of fuel the nozzle body having a recess defining a convex end portion; and an orifice plate disposed downstream of the valve seat surface with respect to a flow of fuel and having a swirling passage allowing fuel to pass therethrough, a swirl chamber disposed downstream of the swirling passage, and a plurality of fuel injection holes that jet swirl fuel, wherein the nozzle body has an end face portion, which is immediately adjacent to, and in direct contact with, the orifice plate, that defines an inclined surface that is convex relative to the axial direction of the nozzle body, the orifice plate having the swirling passage and the swirl chamber is guided by a concave groove-outer circumferential wall portion provided in an outer circumferential portion of the nozzle body so that the orifice plate is fixedly inserted into the nozzle body, the end face portion defines a stepped portion, the orifice plate has a complimentary concave end face to be received in the recessed forming the convex end portion of the nozzle body wherein the convex inclined surface formed on the nozzle body so as to face the orifice plate has a first inclined surface portion facing the swirling passage of the orifice plate and a second inclined surface portion facing the swirl chamber of the orifice plate and wherein a convex inclined surface formed on the orifice plate so as to face the nozzle body has a first inclined surface portion facing the swirling passage and a second inclined surface portion facing the swirl chamber.

8. The fuel injection valve according to claim 7, wherein the first inclined surface portion formed on the nozzle body is located closer to the orifice plate than the second inclined surface portion formed on the nozzle body.

9. The fuel injection valve according to claim 7, wherein the first inclined surface portion formed on the orifice plate is located closer to the nozzle body than the second inclined surface portion formed on the orifice plate.

10. The fuel injection valve according to claim 7, wherein the swirl chamber has a cross-section formed by an involute curve or a helical curve.

11. The fuel injection valve according to claim 8, wherein the swirl chamber has a cross-section formed by an involute curve or a helical curve.

12. The fuel injection valve according to claim 9, wherein the swirl chamber has a cross-section formed by an involute curve or a helical curve.

* * * * *